US006651775B2

(12) United States Patent
Bassett, Jr.

(10) Patent No.: US 6,651,775 B2
(45) Date of Patent: Nov. 25, 2003

(54) LOW LEVEL SCAFFOLD WITH BALLSCREW DRIVE

(76) Inventor: Frederick N. Bassett, Jr., 43 Seabrook Rd., Salisbury, MA (US) 01952

( * ) Notice: Subject to any disclaimer, the term of this patent is extended or adjusted under 35 U.S.C. 154(b) by 34 days.

(21) Appl. No.: 09/905,731

(22) Filed: Jul. 14, 2001

(65) Prior Publication Data

US 2002/0029930 A1 Mar. 14, 2002

Related U.S. Application Data

(60) Provisional application No. 60/221,945, filed on Jul. 31, 2000.

(51) Int. Cl.[7] ..... B66F 7/06

(52) U.S. Cl. ..... 182/69.5; 187/211

(58) Field of Search ..... 182/69.5, 69.1, 182/69.3, 69.2, 63.1, 141, 208, 67.2, 67.5, 157, 158; 74/521, 89.23; 248/421, 277.1, 188.1; 52/109, 111, 6, 7, 29; 108/136, 144–7, 147; 187/204, 211, 267, 18, 269, 862, 872; 254/9 C, 13, 424, 122, 126

(56) References Cited

U.S. PATENT DOCUMENTS

| | | | | | |
|---|---|---|---|---|---|
| 1,365,252 | A | * | 1/1921 | Langill | 52/109 X |
| 1,577,989 | A | * | 3/1926 | Sieber | 182/69.5 |
| 1,597,265 | A | * | 8/1926 | Cashiere | 52/109 |
| 2,402,579 | A | * | 6/1946 | Ross | 52/109 |
| 3,817,346 | A | * | 6/1974 | Wehmeyer | 182/69.5 X |
| 3,820,631 | A | * | 6/1974 | King et al. | 182/141 |
| 3,920,096 | A | * | 11/1975 | Fisher | 182/63.1 |
| 3,982,718 | A | * | 9/1976 | Folkenroth et al. | 248/421 |
| 4,100,850 | A | * | 7/1978 | Wolbrink et al. | 74/521 X |
| 4,405,116 | A | * | 9/1983 | Eisenberg | 254/122 |
| 4,638,610 | A | * | 1/1987 | Heikkinen | 52/109 |
| 4,744,712 | A | * | 5/1988 | Mitchell | 248/421 X |
| 4,830,147 | A | * | 5/1989 | Kawada | 254/122 X |
| 4,926,760 | A | * | 5/1990 | Sack | 248/421 X |
| 5,285,992 | A | * | 2/1994 | Brown | 248/421 |
| 5,317,769 | A | * | 6/1994 | Weismiller et al. | 74/89.15 X |
| 5,445,353 | A | * | 8/1995 | Sakamoto | 248/421 |
| 5,718,325 | A | | 2/1998 | Doster et al. | 198/592 |
| 6,044,927 | A | | 4/2000 | Newlin | 182/69.5 |
| 6,050,365 | A | | 4/2000 | Newlin | 182/69.5 |

* cited by examiner

*Primary Examiner*—Daniel P. Stodola
*Assistant Examiner*—Hugh B. Thompson
(74) *Attorney, Agent, or Firm*—Perkins Smith & Cohen, LLP; Peter J. Borghetti

(57) ABSTRACT

A low level scaffold with ball screw drive is a lightweight, mobile, compact, electrically activated, self-erecting, scissor-type lifting platform. The electronic system utilizes an electric motor in direct drive arrangement with a ball screw assembly to vary the platform height from a retracted position to extended position. Electric switches limit reverse direction between the retracted and extended positions to vary platform height anywhere between the minimum and maximum heights above ground level. The design allows for transportation through household doorways and provides anti-tilt arms with threaded level mounts for use on non-level surfaces. The scaffold provides homeowners and small commercial contractors with an apparatus to perform small interior and exterior projects at elevated heights.

19 Claims, 11 Drawing Sheets

LOW LEVEL SCAFFOLD WITH BALLSCREW DRIVE

CROSS REFERENCE TO RELATED APPLICATIONS

This application claims priority of Provisional Application No. 60/221,945, entitled LOW LEVEL SCAFFOLD filed on Jul. 31, 2000, and which is incorporated herein by reference.

BACKGROUND OF THE INVENTION

This invention relates to a scaffold having an electric drive for lifting a user, equipment, and materials from a ground level to an elevated working level within a contained area of height and width and to stabilize the scaffold on non-level ground, and mobility through interior passageways.

The homeowner and small commercial contractor struggle with small interior and exterior projects that are at elevated heights. They primarily rely are stepladders, stools, and extension ladders for these projects. The user must constantly travel up and down these structures to retrieve tools and materials. The work area is limited to the reach to the user. This places the user in an unsafe situation that may result in a fall from an elevated height. As the user leans to extend his reach, the ladder or stool may become unstable and tilt or the user may loose his grip or balance and fall to the ground. Also, the user needs to constantly reposition the structure as the work progress. This is very inefficient wasting precise time. Stability of the structure is also an issue when working on unleveled surfaces. This is a particular problem when outdoors.

Conventional aerial lifts are primarily designed for commercial and industrial users. The lifts initial purchase costs are high with significant reoccurring maintenance costs. The lifts employ hydraulics to elevate working platforms. The hydraulics requires significant maintenance and are constantly leaking making these machines unsuited for internal use for home or light industrial or small commercial operations. The relative size of the available machines also limits their use to external areas or internal spaces with wide doorways and high ceiling. Their use within a home or office is prohibited due to maneuverability through passageways and the leaking hydraulic fluid. Most conventional aerial lifts are powered by diesel engines, propane motors or large battery packs that also limits their usage within structures due to environment issues.

In order to work safety at elevated heights within a house or office for the purpose of installing or fixing electric fixtures, painting walls or ceiling, or changing light bulbs, it is necessary to have an apparatus that is lightweight, low cost, portable and mobile, anti-tilt, sufficient load lifting capabilities, compact design in full retracted position, transportable through doorways, platform work area sufficient to reduce up and down trips by operator, level mount features allow placement on non-level surfaces, and a motorized direct drive elevating means to eliminate the hydraulics.

Accordingly, several objects and advantages of my invention are to provide the consumer with a low cost, portable, mobile, multi-purpose scaffold for household use and light duty construction and maintenance.

It is a further object of this invention to provide a scaffold that is of lightweight construction with anti-tilt features.

It is a further object of this invention to provide a scaffold that has load-lifting capabilities up to 600 pounds.

It is another object of this invention to provide a scaffold that is compact in full-retracted position.

It is another object of this invention to provide a scaffold that is transportable through building doorways.

It is yet another object of this invention to provide a scaffold with a platform work area that limits up and down trips by operator.

It is a further object of this invention to a scaffold with level mount features that allow a scaffold to be placed on non-planar surfaces.

It is a further object of this invention to provide a scaffold with a motor direct drive system that eliminates oil leakages associated with hydraulic systems.

Still further objects and advantages will become apparent from a consideration of the ensuing description and accompanying drawings.

SUMMARY OF THE INVENTION

The objects set forth above as well as further and other objects and advantages of the present invention are achieved by the embodiments of the invention described hereinbelow.

Briefly stated, the preferred embodiment introduces an improvement in scissor advancement mechanism that enables significant reduction in the size of a lifting scaffold for multipurpose use. The present invention provides a means for lifting construction material, tools and workman to working heights within a confined working area. For example, one embodiment of the present invention provides a lifting platform of conventional design wherein the platform is lifted from ground level and maintained in a substantially level height by a known scissor arrangement. The invention is sized to allow transportation through household doorways and other limiting structures. The scissor arrangement raises a load by mechanical lifting means driven by at least on electric motor means powered by AC or DC power. Preferably the mechanical lifting means includes at least one ball screw. The ball screw is connected to the scissor arrangement such that as the electric motor rotates the screw, the scissors open and the platform raises. The present invention employs the advantages of using a mechanical drive rather than hydraulic fluid to elevate the platform.

An alternative embodiment includes electric micro switches provided in the assembly design to limit the extension and retraction position of the upper movable platform anywhere within a desired height range, preferably between 1 and 6.5 feet above surface level. These micro switches shut down electric power to the drive motor when mechanically activated.

Another alternative embodiment includes casters for maneuverability and allows the operator to transport the apparatus from location to location in similar manner to a dolly.

Yet another alternative embodiment includes stabilizing arms located on the stationary base to preclude the assembly from tipping over when the upper movable platform is fully extended. Leveling mounts located on the stabilizing arms allow the assembly to be mounted on non-level surfaces.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

Figure 1:
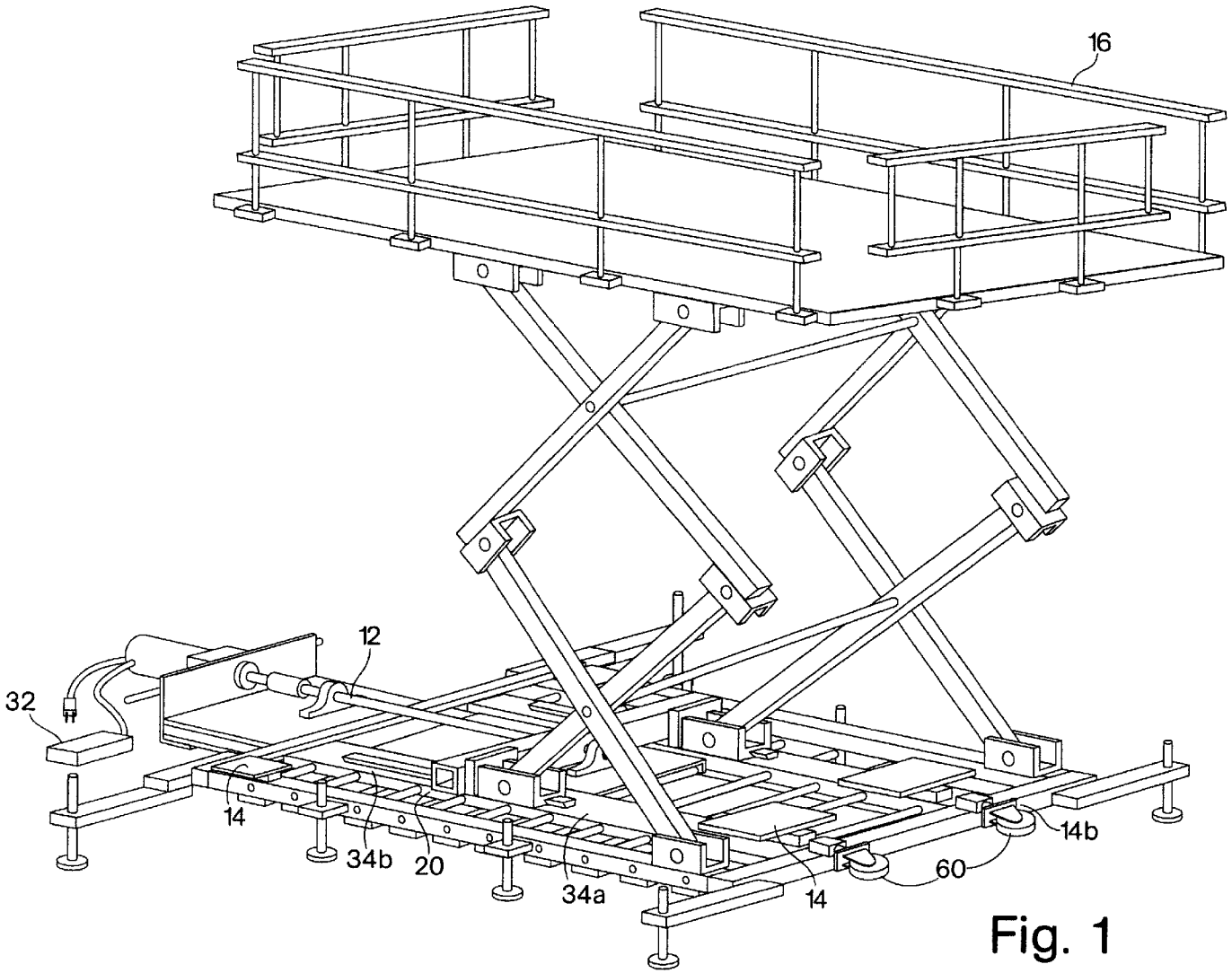
FIG. 1 is pictorial of the preferred embodiment.

The preferred embodiment 10 (FIG. 1) includes an improved scissor advancement mechanism 12 (FIG. 2) that enables significant reduction in the size of a lifting scaffold for multipurpose use. Though the basic design of the stationary base 14, the upper movable platform 16, and the scissor assemblies 18 are standard and known to the art (also illustrated in FIGS. 3*a* and 3*b*), as discussed in detail in Provisional Application No. 60/221,945, entitled LOW LEVEL SCAFFOLD, the combination of the compact size and the improved scissor advancement mechanism 12 advances the art of lifting platforms. Each of the novel features will be discussed in detail below. Though a compact-sized lifting scaffold is illustrated, any size lifting scaffold is within the contemplation of the invention.

As illustrated in FIGS. 1, 2, 3*a*, and 3*b*, the preferred embodiment 10 is comprised of a scissor advancement mechanism 12, a stationary base 14, an upper movable platform 16 disposed above the stationary base 14, scissors lifting assemblies 18 having a lower 18*a* and upper portion 18*b* being interconnected between the stationary base 14 and the upper movable platform 16, and a rail system 20. The rail system 20 is fixedly connected to the scissor advancement mechanism 12, in slidable contact with the stationary base 14 and upper movable platform 16, and pivotally coupled to the scissors lifting assemblies 18. The rail system (not shown) for the upper movable platform 16 is the same as for the stationary base 14, and therefore the discussion of the rail system 20 adapted to the stationary base 14 is applicable to a rail system adapted to the upper movable platform 16.

Figure 2:
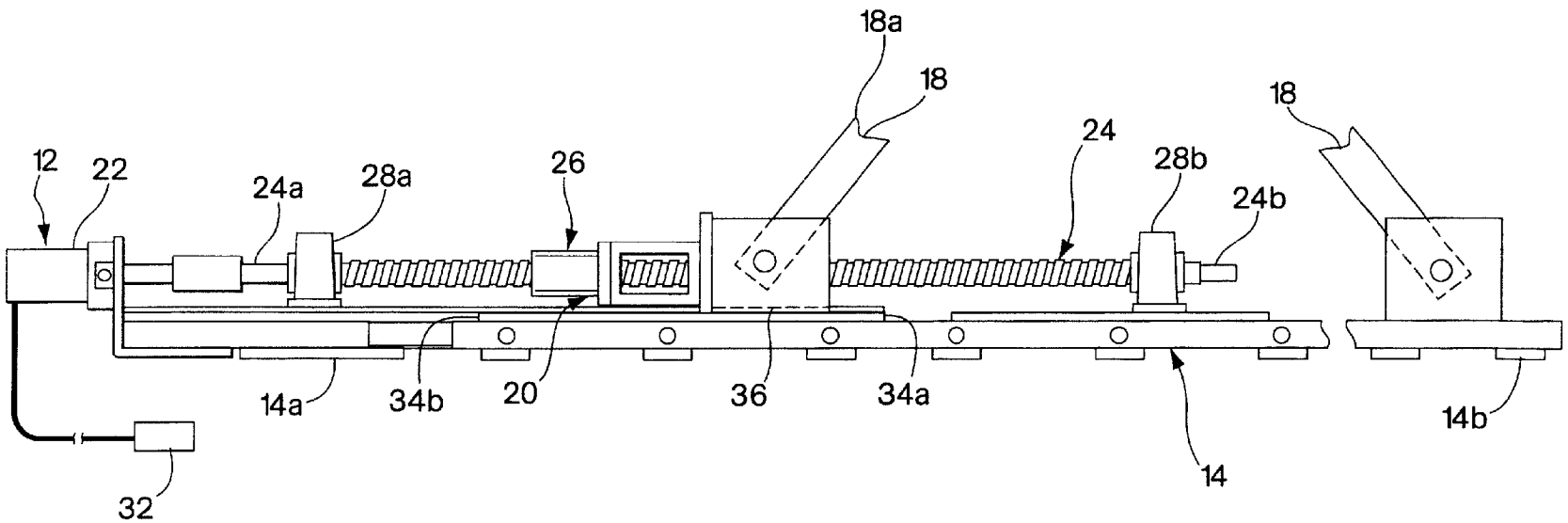
FIG. 2 is a side view of the scissor advancement mechanism attached to the stationary base and coupled to a scissor arm.
Figure 4:
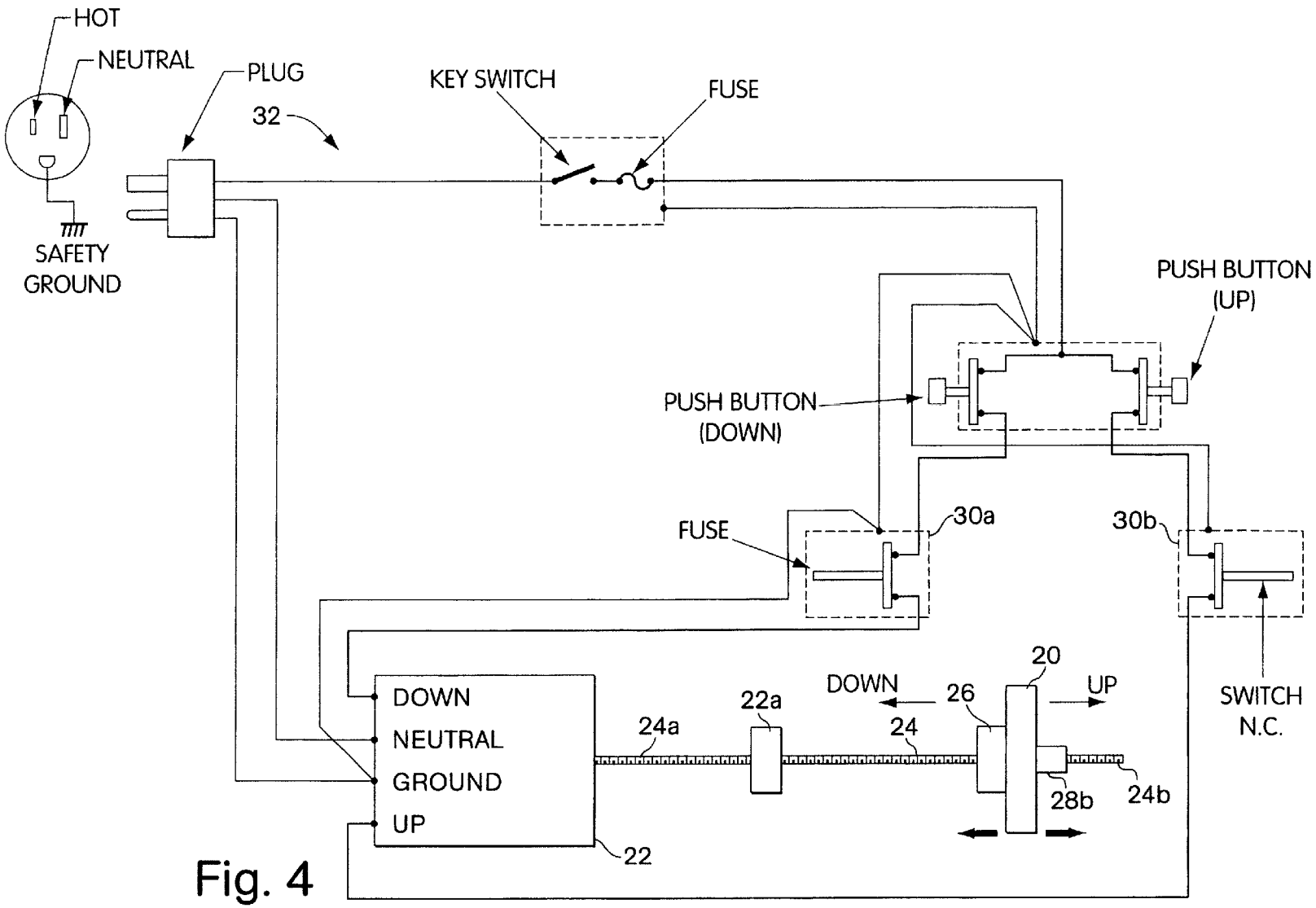
FIG. 4 is a schematic of the electrical circuitry.

The scissor advancement mechanism 12 is a combination of mechanical and electrical components, as illustrated in FIGS. 2 and 4. The scissor advancement mechanism 12 comprises a drive motor 22, an externally threaded ball screw shaft 24 having a first 24*a* and a second 24*b* ends, an internally threaded nut 26, two bearings 28*a*, 28*b*, electric micro switches 30*a*, 30*b* (FIG. 4 only), and a hand control 32. The scissor advancement mechanism 12 (as shown in FIG. 2.) is fixedly mounted to the stationary base 14 with the drive motor 22 being mounted at the first end 14*a*, which opposes the scissors lifting assemblies 18 fixed pivotable attachment point at the second end 14*b*.

Figure 5:
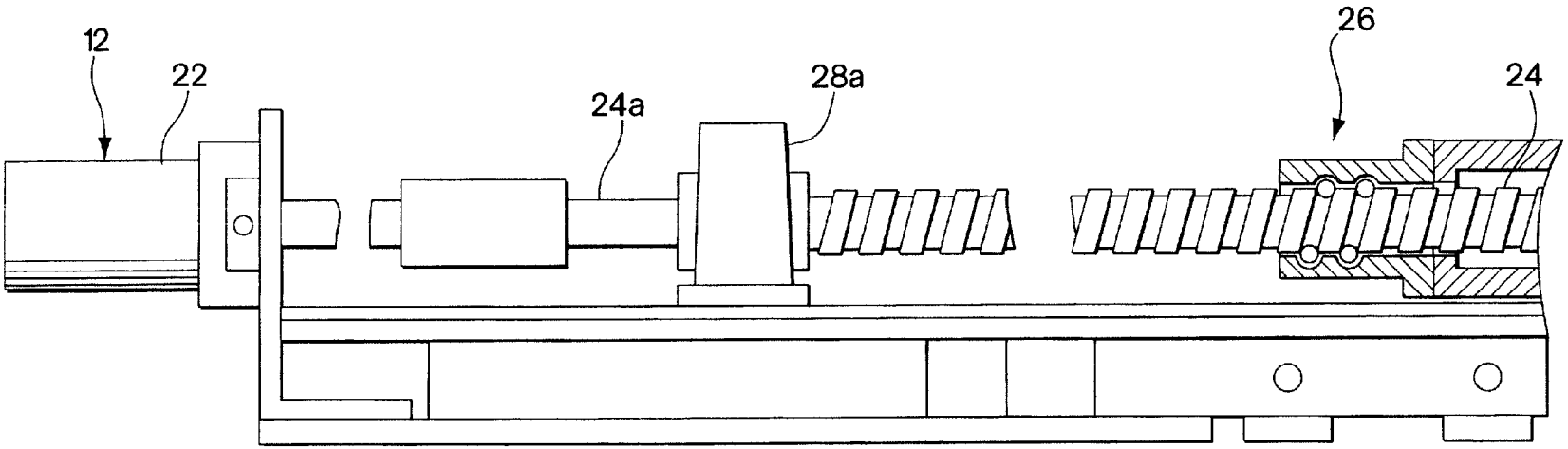
FIG. 5 is a cross-section of the ball screw mechanism.
Figure 6A:
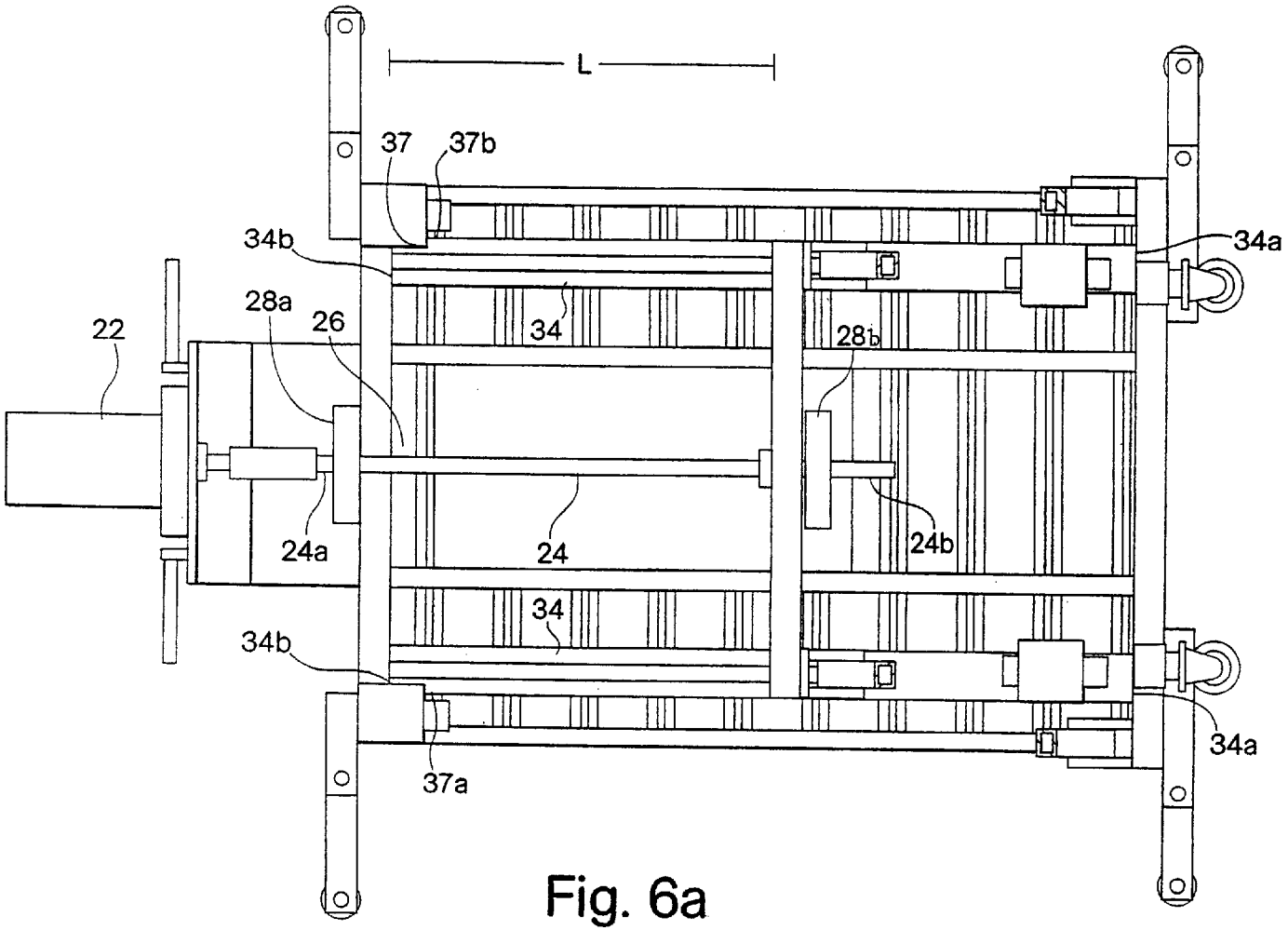
FIG. 6*a* is a top view of the scissor advancement mechanism in the fully extended position.
Figure 6B:
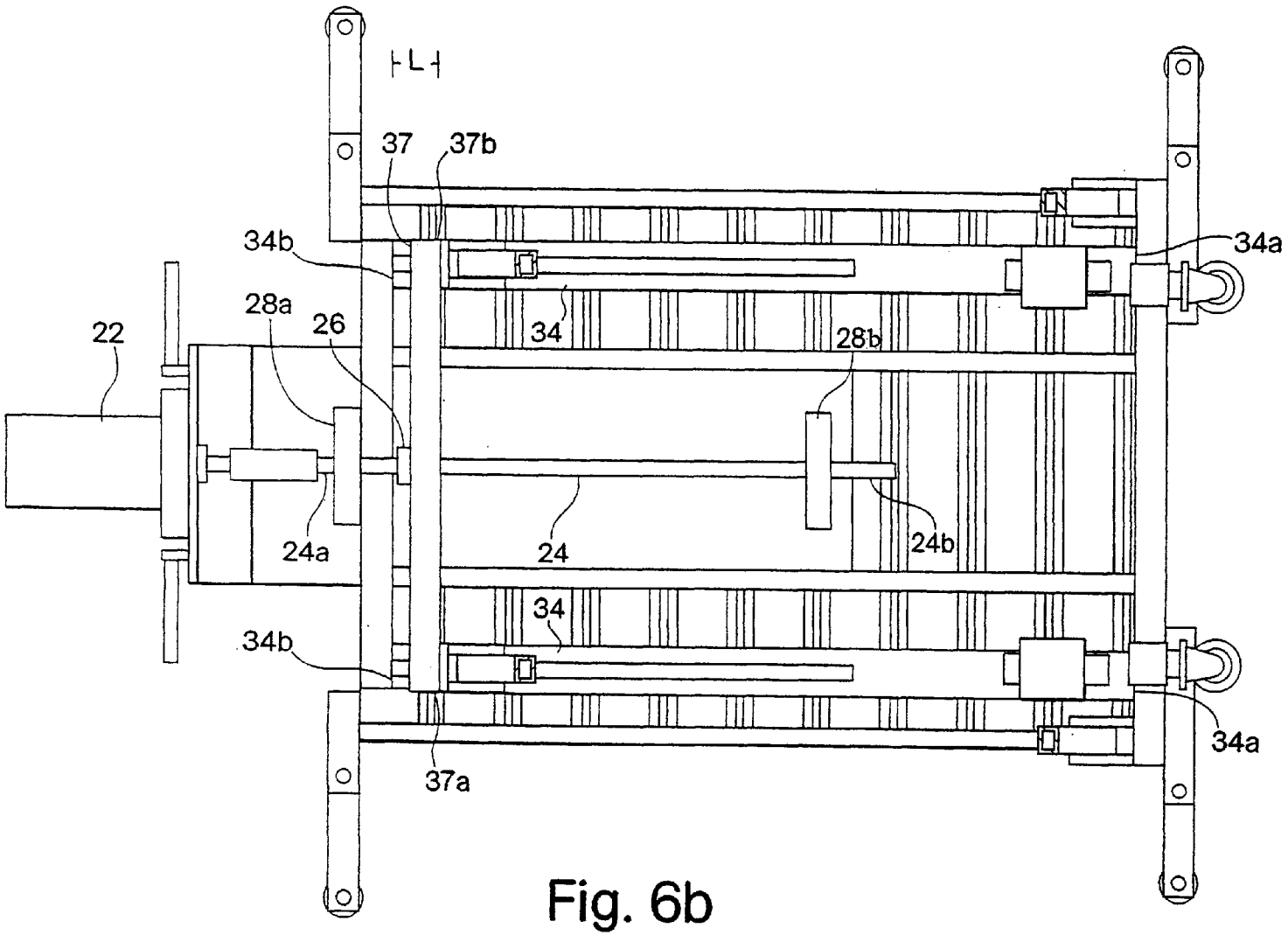
FIG. 6*b* is a top view of the scissor advancement mechanism in the fully retracted position.

As illustrated in FIGS. 5, 6*a*, and 6*b*, the internally threaded nut 26 is threadably rotatable on the ballscrew shaft 24, and is responsive to rotation of the ballscrew shaft 24 in the opposite first R' and second R" angular directions. The internally threaded nut 26 is movable in the opposite first L' and second L" linear directions between a retracted position, wherein the internally threaded nut 26 is located adjacent to the first end 24*a* of the ballscrew shaft 24, and an extended position, wherein the internally threaded nut 26 is located adjacent to the second end 24*b* of the ballscrew shaft 24.

The wiring schematic shown in FIG. 4 illustrates the elevation control of the upper movable platform 16. Electric micro switches 30*a*, 30*b* are provided on the stationary base 14 and upper movable platform 16 at predetermined locations to limit the extension and retraction position of the upper movable platform 16 anywhere within a desirable height range, preferably between 1 and 6.5 feet above surface level. These micro switches 30*a*, 30*b* shut down electric power to the drive motor 22 when mechanically activated. Electronic switch 30*a* shuts down power when the upper movable platform 16 descends below a predetermined point. Electronic switch 30*b* shuts down power when the upper movable platform 16 ascends above a predetermined point. A hand control 32 electrically connected to the drive motor 22 allows the operator to vary the height of the upper movable platform 16. The drive motor 22 of this assembly is single-phase operating from 115 volts, 60-hertz or 230 volts, 50-hertz household AC electric power or DC electric power.

The rail system 20 connects the major components of the preferred embodiment 10. As mentioned above, the rail system 20 is fixedly connected to the scissor advancement mechanism 12, in slidable contact with the stationary base 14 and upper movable platform 16, and pivotally coupled to the scissors assemblies 18. As illustrated in FIG. 1, the rail system 20 includes two rails 34, two rail guides 36,and a drive tube 37. There are two rails 34 and two guide rails 36 for each the stationary base 14 and the upper movable platform 16. The disclosure will be in terms of a rail system mounted on the stationary base 14, however the structure for a rail system mounted to the upper movable platform 16 is exactly the same regarding the rails, the rail guides, and pivotal coupling with the scissor assemblies 18.

As illustrated in FIGS. 1, 6*a*, 6*b*, 7 and 8, the rail 34 includes an opposite first 34*a* and second 34*b* ends, and a top surface 34*c*, and is mounted longitudinal on the stationary base 14 between the stationary base ends 14*a* and 14*b*. The positioning of the rail and number of rails are dependent on the load limits of the invention. The top surface 34*c* was made of or coated with low friction material for easy rail guide 36 sliding.

The drive tube 37 is used to connect multiple rail guides 36 to the same drive motor 22. As illustrated in FIGS. 6*a* and 6*b*, the preferred embodiment 10 uses one drive motor 22 working in cooperation with one ballscrew shaft 24, one internally threaded nut 26, and two rails 34. Therefore, a coupling between the two rails 34 is required to translate both rail guides 36 along the rails 34 simultaneously. In cases where only one rail 34 is used, then there is no need for the drive tube 37.

Figure 7:
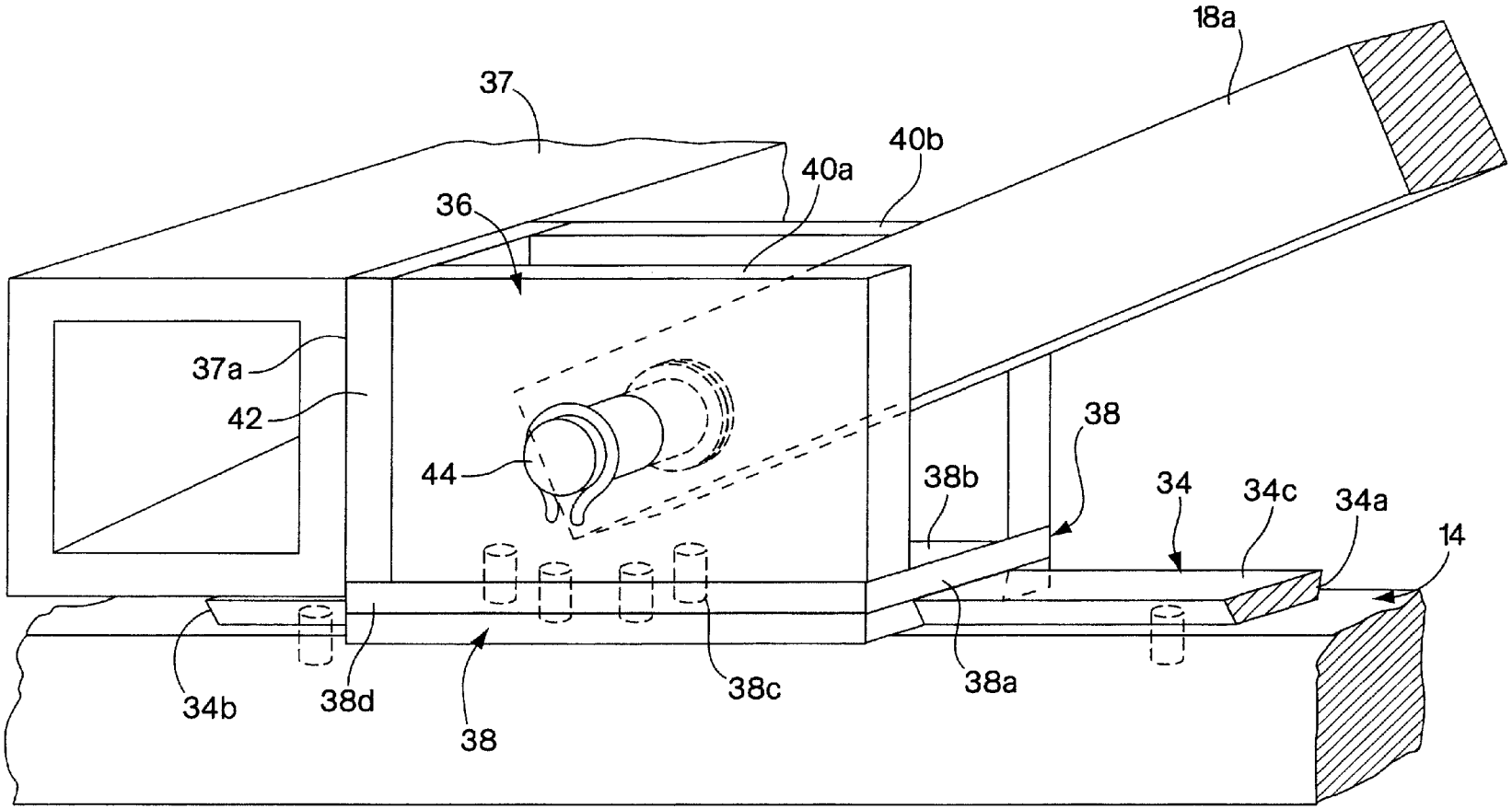
FIG. 7 is a pictorial view of a lower rail.
Figure 8:
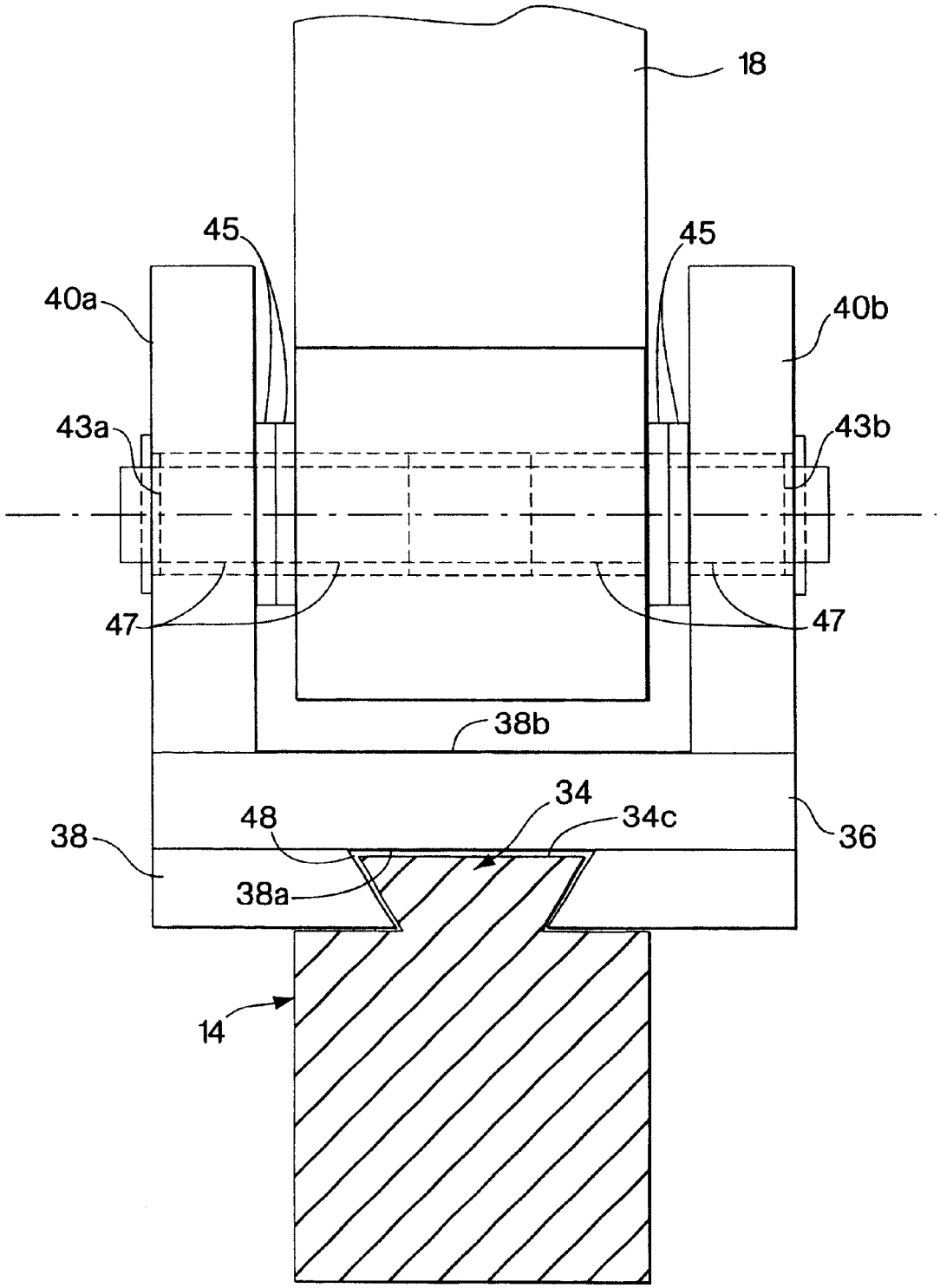
FIG. 8 is a front view of the dovetail rail configuration.

As illustrated in FIGS. 7 and 8, the rail guide 36 includes a base plate 38, a pair of pivot plates 40*a*, 40*b*, and a coupling plate 42. The base plate 38 includes a lower surface 38*a*, a top surface 38*b*, and opposite first end 38*c* and second end 38*d*. The second end 38*d* being attached at a first end 37*a* of the drive tube 37. As illustrated in FIGS. 6*a* and 6*b*, the drive tube 37 is fixedly attached to the internally threaded nut 26 at a predetermined location such that when the internally threaded nut 26 undergoes movement in the opposite first L' and second L" linear directions the drive tube 37 applies equal force upon the rail guides 36, whereby the rail guides 36 move along the rails 34 at the same velocity and distance.

As illustrated in FIGS. 7 and 8, the rail guide 36 includes pivot holes 43*a*, 43*b* sufficiently sized to mount a plurality of low friction material flanged sleeve bearings 45. The scissor lift lower portion 18*a* also includes a pivot hole 46 (not shown) sufficiently sized to mount a plurality of low friction material flanged sleeve bearings 45. All flanged sleeve bearings 45 include a sleeve pivot hole 47 sufficiently sized such that a round shaft 44 freely rotates. Thereby, the guide rail 36 and the lower portions 18*a* of the scissor lift assembly are rotatably coupled by the round shaft 40 to operate the scissor lifting assembly 18 between the retracted (FIG. 3*b*) and expanded (FIG. 3*a*) conditions as the ballscrew shaft 24 is rotated in the opposite first R' and second R" angular directions.

The rail guide base lower surface 38*a* is in slidable contact with the top surface 34*c* of the rail 34 as the rail guide 36 translates in the opposite first L' and second L" linear directions. The base plate 38 of the rail guide 36 further includes a channel 48 through the lower surface 38*a*. The channel 48 of the rail guide 36 and the rail 34 are a dovetail configuration (FIG. 8), both sufficiently sized such that the channel 48 of the rail guide 36 freely slides along the rail 34, and to contain the rail guide 36 from extending upwardly under loading conditions as the rail guide 36 translates in the opposite first L' and second L" linear directions.

The rail system 49 (partial shown in FIG. 1) of the upper movable platform 16 is identical to the rail system 20 described above. The rail guide 50 of the upper movable platform 16 translates along the rail (not shown) attached to the upper movable platform 16 as the upper portion 18*b* of the scissor assemblies 18 applies a force to the rail guides 50 similar to the force applied by the drive tube 37 upon the rail guides 36 on the stationary base 14.

MODE OF OPERATION

Figure 3A:
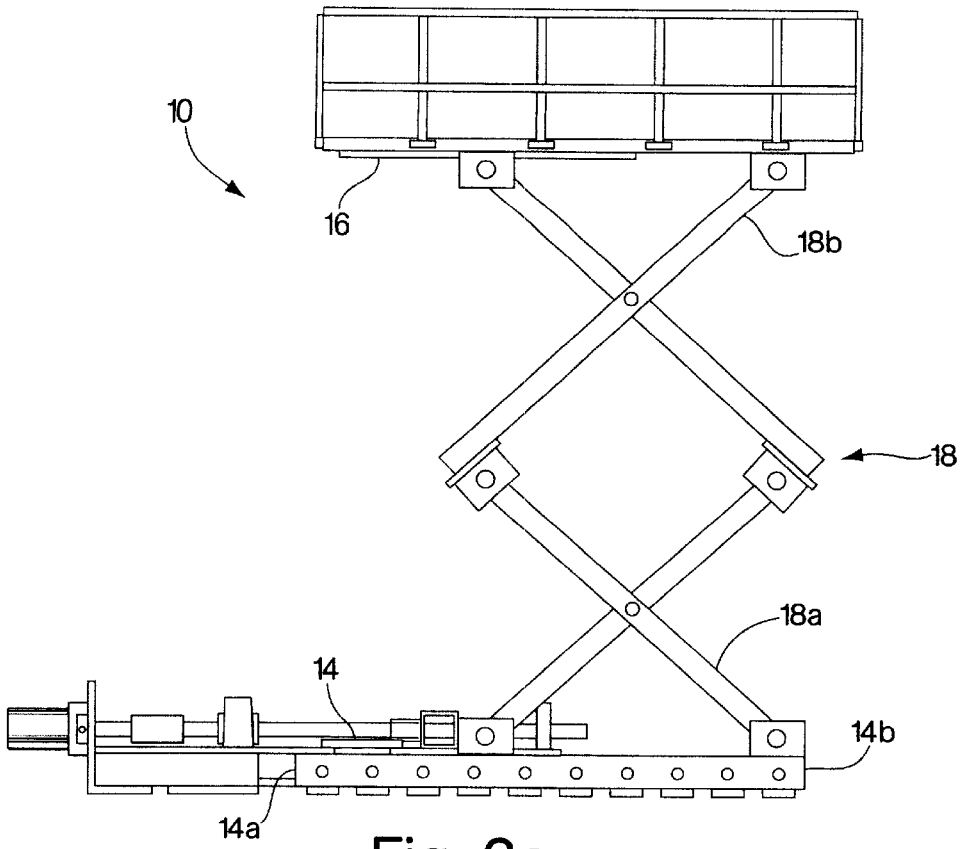
FIG. 3*a* is a side view of the preferred embodiment in a fully extended position.

The operator of the present invention positions the invention in a work area, loads the material and tools on to the upper movable platform 16, steps on to the upper movable platform 16, and turns on the motor. The operator pushes the up button to engage the drive motor 22 with the ballscrew shaft 24. The ballscrew shaft 24 undergoes rotation R' in a first angular direction. The internally threaded nut 26 undergoes translation L' in a first linear direction so as to cause movement of the scissors assemblies 18 vertically toward the extended condition and thereby movement of the upper movable platform toward the raised position (FIG. 3*a*). When the operator reaches the desired height, the operator releases the up button to disengage the ballscrew shaft 24 from the drive motor 22.

Figure 3B:
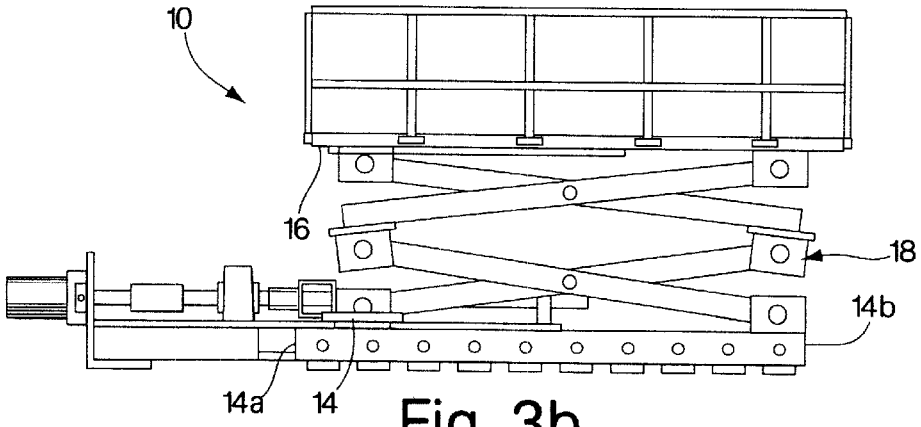
FIG. 3*b* is a side view of the preferred embodiment in a fully retracted position.

Upon completion of the work, the operator pushes the down button and the upper movable platform 16 descends. The ballscrew shaft 24 undergoes rotation R" in a second angular direction opposite to the first angular direction, and the internally threaded nut 26 undergoes translation L" in a second linear direction opposite to the first linear direction so as to cause movement of the scissor assemblies 18 vertically toward the retracted condition and thereby movement of the upper movable platform 16 toward the lowered position (FIG. 3*b*). Once the upper movable platform 16 lowers to the desire ascent height, the operator releases the down button.

Preferably, the scissor advancement mechanism 12 also includes electronic switches 30*a*, 30*b* (as mentioned above), which effectively stop the upper movable platform 16 at maximum ascent and descent heights.

Figure 9:
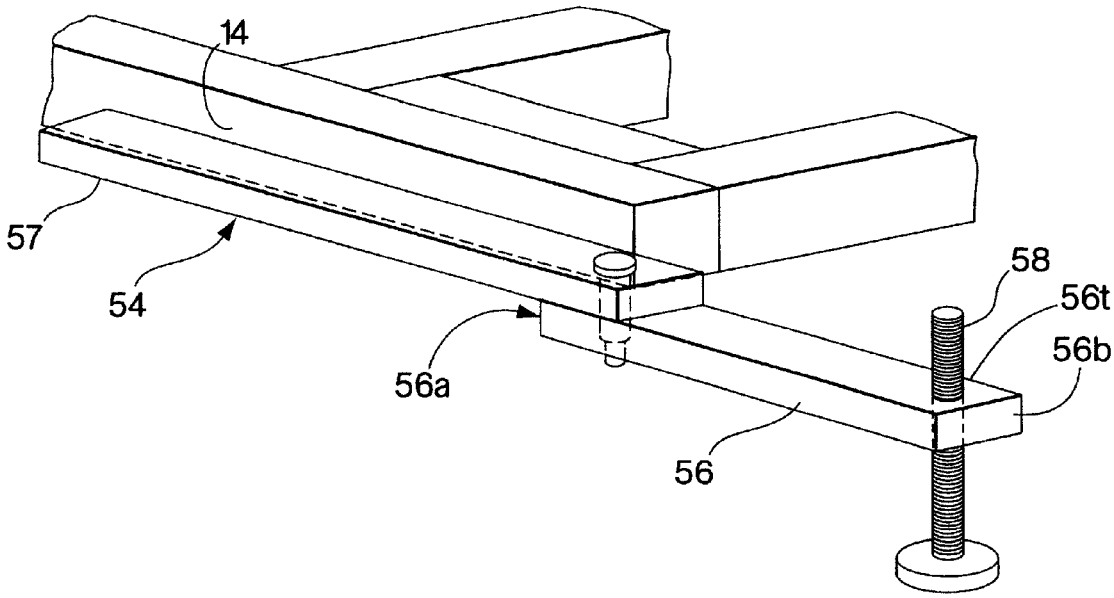
FIG. 9 is a pictorial view of a stabilizing arm.

An alternative embodiment, illustrated in FIG. 1, includes stabilizing arms 54 connected to predetermined locations of the stationary base 14. As illustrated in FIG. 9, the stabilizing arm 54 includes a pivot arm 56, having opposite first 56*a* and second 56*b* ends, and a mounting arm 57. The mounting arm 57 being fixedly attached to the stationary base 14. The pivot arm first end 56*a* is pivotally coupled to the mounting arm 57 for retraction when the apparatus is not in use and extension when the apparatus is in use. The second end 56*b* includes a threaded hole 56*t* to receive an externally threaded swivel level mount 58, whereby the stabilizing arms 54 are variably extendible for use in confined areas or for adjusting for loads that affect the center of gravity of the apparatus. The externally threaded swivel level mount 58 is threadably rotatable into the threaded hole 56*t* of the pivot arm 56, whereby the swivel level mount 58 is threaded into the threaded hole 56T of the pivot arm 56 to a height sufficient to adapt the apparatus for use on non-level surfaces providing a stable surface for the apparatus to operate.

In another alternative embodiment, the stationary base 14 further includes at least one caster 60 (FIG. 1), whereby the caster adapts the apparatus for easy movement, transportation, repositioning, or realignment by one individual.

Figure 10:
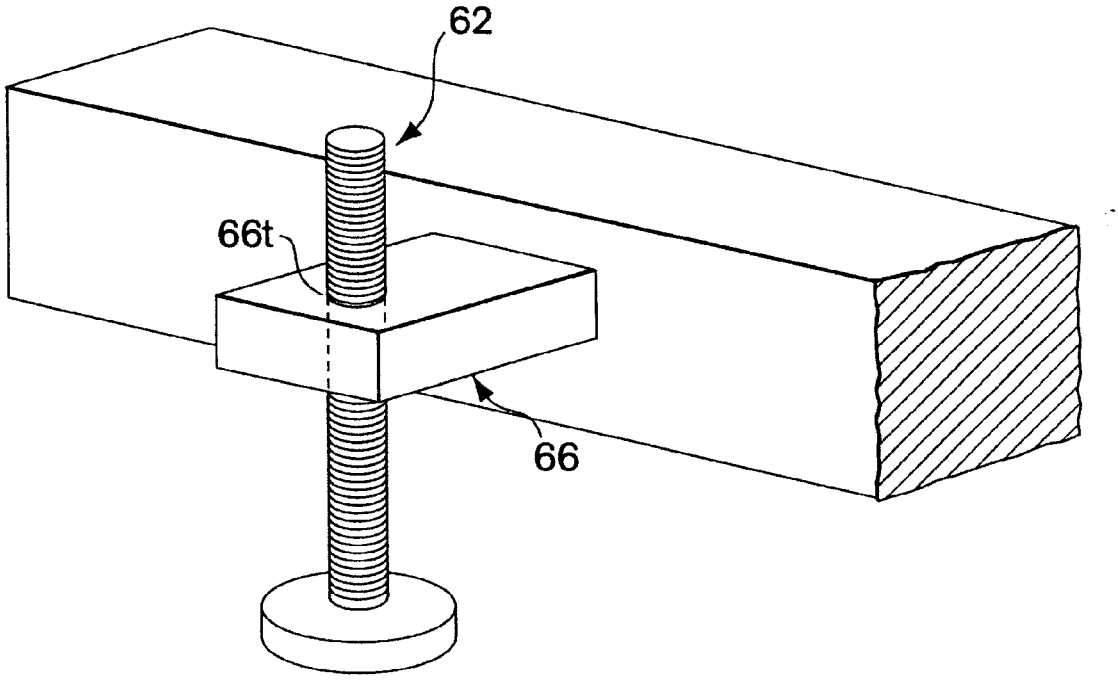
FIG. 10 is a pictorial view of a level mount.

In yet another alternative embodiment, the stationary base 14 further includes a plurality of externally threaded swivel level mounts 62 (FIG. 10) being connected to predetermined locations of the stationary base 14. The threaded swivel level mount 62 is threadably rotatable into the threaded hole 66*t* of a mount plate 66, whereby the swivel level mount 62 is threaded into the threaded hole 66T of the mount plate 66 to a height sufficient to adapt the apparatus for use on non-level surfaces providing a stable surface for the apparatus to operate. The mount plate 66 is fixedly attached to the stationary base 14.

Although the invention has been described with respect to various embodiments, it should be realized this invention is also capable of a wide variety of further and other embodiments within the spirit and scope of the appended claims.

What is claimed is:

1. A low level scaffold, comprising:

a base having a first end, a second end, and two longitudinal sides, said two longitudinal sides interconnecting said first end and said second end forming a substantially rectangular frame defining a plane;

a movable platform disposed above said base;

a lifting assembly operably connected to said base and said movable platform;

means for actuating said movable platform between a lowered position and a raised position, said actuating means being mounted to said base and being pivotally coupled to said lifting assembly, wherein said base and said movable platform in the lowered position form a structure being capable of fitting through openings; and means for transporting said scaffold attached to said first end outwardly extending from said base in substantially said plane and substantially parallel to said two longitudinal sides, said transporting means rotatable about a substantially vertical axis, whereby said scaffold being capable of transportation through doorways by a user lifting said second end to a predetermined height causing engagement of said transporting means with a surface.

2. The scaffold as recited in claim 1, wherein said actuating means comprises:

a motor;

an externally threaded ballscrew shaft having opposite first and second ends, said first end being rotatably connected directly to said motor; and an internally threaded nut threadably rotatably attached to said ballscrew shaft and pivotally connected to said lifting assembly.

3. The scaffold as recited in claim 2, wherein said actuating means further comprises at least one support bearing operably coupled to said first end or said second end of said ballscrew shaft.

4. The scaffold as recited in claim 2, wherein said actuating means further comprises at least one limiting switch to cut power to said motor before exceeding predetermined lowered and raised positions.

5. The scaffold as recited in claim 2, further comprising:

at least one rail having opposite first and second ends, and a top surface; and at least one rail guide having a mount plate with a lower surface and opposite first and second ends being attached at said first end to said actuating means for undergoing movement therewith in an opposite first and second linear directions, said lower surface in slidable contact with said top surface of said at least one rail as said at least one rail guide translates in the opposite first and second linear directions, said at least one rail guide being pivotally connected to said lifting assembly.

6. The scaffold as recited in claim 2 further comprises:

a plurality of rails, each rail of said plurality of rails having opposite first and second ends, and a top surface;

a plurality of rail guides, each rail guide of said plurality of rail guides having a mount plate with a lower surface and opposite first and second ends, said lower surface in slidable contact with said top surface of said each rail as said each rail guide translates in the opposite first and second linear directions, said plurality of rail guides being pivotally connected to said lifting assembly; and a drive tube having a first and a second surface, said first surface being attached to said first end of said plurality of rail guides, said second surface being attached to said nut for undergoing movement therewith in the opposite first and second linear directions.

7. The scaffold as recited in claim 1, wherein said lifting assembly comprises a plurality of pivot holes.

8. The scaffold as recited in claim 1, wherein said base further comprises support means for adjustably elevating and supporting said base above the floor.

9. The scaffold as recited in claim 8, wherein said support means comprises a plurality of externally threaded swivel level mounts being capable of substantially leveling said scaffold on non-level floors.

10. The scaffold as recited in claim 8, wherein said base further comprises a plurality of stabilizing arms.

11. The scaffold as recited in claim 10, wherein said stabilizing arms include:

a pivot arm having opposite first and second ends, said first end being pivotally coupled to said base for retraction when said scaffold is not in use and extension when said scaffold is in use, said second end having a threaded hole, whereby said stabilizing arms are variably extendible for use in confined areas or for adjusting for loads that affect the center of gravity of said scaffold; and an externally threaded swivel level mount threadably rotatable into said threaded hole of the pivot arm, said swivel level mount threaded into said threaded hole of the pivot arm to a height sufficient to adapt said scaffold for use on non-level surfaces, whereby providing a stable surface for said scaffold to operate.

12. The scaffold as recited in claim 1, wherein said transporting means comprises at least one caster.

13. The scaffold as recited in claim 1 further comprises an electric motor.

14. A low level scaffold, comprising:

a stationary base, said stationary base having a first end, a second end and an upper surface;

an upper movable platform disposed above said stationary base, said upper movable platform having a lower surface;

a plurality of scissors lifting assemblies being interconnected between said stationary base and said upper movable platform, said plurality of scissors lifting assemblies having a lower and an upper portion, wherein said lower and said upper portions of said plurality of scissors lifting assemblies include a plurality of pivot holes;

scissor advancement means being fixedly mounted to said stationary base between said first and said second ends of said stationary base and being pivotally coupled to said lower portion of said plurality of scissors lifting assemblies and adapted to operate said plurality of scissors lifting assemblies between retracted and expanded conditions, said scissor advancement means being operable to undergo rotation in a first angular direction and translation in a first linear direction so as to cause movement of said plurality of scissors lifting assemblies vertically toward the retracted condition and thereby movement of said upper movable platform toward a lowered position and to undergo rotation in a second angular direction opposite to the first angular direction and translation in a second linear direction opposite to the first linear direction so as to cause movement of said plurality of scissors lifting assemblies vertically toward the expanded condition and thereby movement of said upper movable platform toward a raised position;

a plurality of rails having opposite first and second ends, and a contact surface, said plurality of rails comprises at least one lower rail fixedly attached to said upper surface of said stationary base and at least one upper rail fixedly attached to said lower surface of said upper movable platform, said at least one lower rail comprising a contact surface, and said at least one upper rail comprising a contact surface; and at least one lower rail guide having a mount plate with a contact surface and opposite first and second ends, said contact surface in slidable contact with said contact surface of said at least one lower rail of said stationary base as said at least one lower rail guide translates in the opposite first and second linear directions, said at least one lower rail guide being pivotally connected to said lower portion of said plurality of scissors lifting assemblies, wherein said at least one lower rail guide further comprises a round shaft, said round shaft of predetermined size being capable of free rotation within said plurality of pivot holes of said plurality of scissors lifting assemblies, and a mobile pivot assembly having a pair of pivot plates having a plurality of pivot holes of predetermined diameter to loosely receive said round shaft, said pair of pivot plates mounted to and extending upwardly from and on opposite sides of said mount plate for rotatable connection with said lower portion of said plurality of scissors lifting assemblies interposed between said pair of pivot plates, said mobile pivot assembly and said lower portion of plurality of scissors lifting assemblies rotatably coupled by said round shaft.

15. The scaffold as recited in claim 14, wherein said mount plate of said at least one lower rail guide further comprises a channel of predetermined size along said contact surface to contain said at least one lower rail from extending upwardly under loading conditions as said at least one lower rail guide translates in the opposite first and second linear directions.

16. The scaffold as recited in claim 15, wherein:

said channel of said at least one lower rail guide comprises a dovetail configuration; and said at least one lower rail comprises a dovetail configuration, said dovetail configuration of predetermined size to freely slide within said channel of said at least one lower rail guide.

17. The scaffold as recited in claim 14, further comprising at least one upper rail guide having a mount plate with a contact surface and opposite first and second ends, said contact surface in slidable contact with said contact surface of said at least one upper rail as said at least one upper rail guide translates in the opposite first and second linear directions, said at least one upper rail guide being pivotally connected to said upper portion of said plurality of scissors lifting assemblies, wherein said at least one upper rail guide comprises a round shaft, said round shaft of predetermined size being capable of free rotation within said plurality of pivot holes of said plurality of scissors lifting assemblies, and a mobile pivot assembly having a pair of pivot plates, said pair of pivot plates comprising a plurality of pivot holes of predetermined size to loosely receive said round shaft, said pair of pivot plates mounted to and extending downwardly from and on opposite sides of said mount plate for rotatable connection with said upper portion of said plurality of scissors lifting assemblies interposed between said pair of pivot plates, said mobile pivot assembly and said upper portion of said plurality of scissors lifting assemblies rotatably coupled by said round shaft.

18. The scaffold as recited in claim 17, wherein said mount plate of said at least one upper rail guide further comprises a channel of predetermined size along said contact surface to contain said at least one upper rail from extending downwardly under loading conditions as said at least one upper rail guide translates in the opposite first and second linear directions.

19. The scaffold as recited in claim 18, wherein:

said channel of said at least one upper rail guide comprises a dovetail configuration; and said at least one upper rail comprises a dovetail configuration, said dovetail configuration of predetermined size to freely slide within said channel of said at least one upper rail guide.

* * * * *